US005125696A

United States Patent [19]

Robida et al.

[11] Patent Number: 5,125,696

[45] Date of Patent: Jun. 30, 1992

[54] CYLINDRICAL LOCK ASSEMBLY

[75] Inventors: James E. Robida, Cobalt; Kenneth W. Strickland, South Windsor, both of Conn.

[73] Assignee: Emhart Inc., Newark, Del.

[21] Appl. No.: 596,451

[22] Filed: Oct. 12, 1990

[51] Int. Cl.[5] ..... E05C 1/16

[52] U.S. Cl. ..... 292/169.16; 292/DIG. 61

[58] Field of Search ..... 292/348, 357, 244, 336.3, 292/DIG. 61, 169.16, 169.22, 169.23

[56] References Cited

U.S. PATENT DOCUMENTS

| | | | |
|---|---|---|---|
| 124,936 | 3/1872 | Craw . | |
| 2,811,384 | 10/1957 | Schmid | 292/357 |
| 3,471,190 | 10/1969 | Wanserough et al. | 292/356 |
| 3,550,411 | 12/1970 | Neary et al. | 70/370 |
| 4,037,865 | 7/1977 | Hook | 292/357 |
| 4,453,753 | 6/1984 | Fayerman et al. | 292/357 X |
| 4,502,720 | 3/1985 | Fayerman et al. | 292/357 X |
| 4,869,083 | 9/1989 | DeMarseilles et al. | 292/357 X |
| 4,998,760 | 3/1991 | Nixon et al. | 292/DIG. 61 X |

*Primary Examiner*—Richard E. Moore
*Attorney, Agent, or Firm*—J. Bruce Hoffnagle

[57] ABSTRACT

A cylindrical lock assembly (20) includes an inside subassembly (22) and an outside subassembly (24) which are assembled with a door (326). Each subassembly (22,24) includes a rose liner (26,38), a return spring cassette (28,40), a rose (30,42), a lever (32,46) and a lever insert (34,48). The inside subassembly (22) also includes a turn button (36) and the outside subassembly (24) includes a cylinder lock (44).

The subassemblies (22,24) are assembled onto respective sleeves (168,170) of a chassis (50) which facilitates the retraction of a latchbolt (54) upon operation of either of the levers (32,46).

Cassettes (28,40) are mounted in the lock assembly (20) by a pair of screws with one screw being inserted from one side of the door (326) and the other screw being inserted from the other side of the door.

9 Claims, 6 Drawing Sheets

40
76
78
80
82
84
86
88
92
94
96
98
102
170
186
400
402
404
406
408
410
412
414
416
418
420
422
424
425
426

CYLINDRICAL LOCK ASSEMBLY

CROSS-REFERENCE TO RELATED APPLICATIONS

The following applications are cross referenced herein as related applications, are filed on even date herewith, and are incorporated herein, by reference thereto.

1. Title: Cylinder Lock
   U.S. Ser. No. 07/596,888, filed Oct. 12, 1990
   Applicants: James E. Robida; Richard M. Davidian; Vladimir Freilich
2. Title: Cylindrical Lock Assembly
   U.S. Ser. No. 07/596,882, filed Oct. 12, 1990
   Applicants: Mohammed A. Haq; Edward T. Leitkowski, Jr.
3. Title: Cylindrical Lock Assembly
   U.S. Ser. No. 07/596,881, filed Oct. 12, 1990
   Applicants: James E. Robida; Edward T. Leitkowski, Jr.
4. Title: Cylindrical Lock Assembly
   U.S. Ser. No. 07/596,890, filed Oct. 12, 1990
   Applicants: James E. Robida; Kenneth W. Strickland

BACKGROUND OF THE INVENTION

This invention relates to a cylindrical lock assembly and particularly to a cylindrical lock assembly having cassettes of uniform construction for interchangeability.

In conventional lever lock set assemblies, the spring of the cassette on one side of the door, for example the inside, must be wound in a dedicated fashion in comparison to the spring on the other side of the door in order to compress the spring upon operation of the associated lever. Further, all mounting screws are typically mounted from the inside of the door and are threadedly fastened into threaded holes in the cassette mounted on the outside of the door.

When a user wishes to reverse the inside-outside arrangement of the door, the cassettes must be disassembled to remove the springs for reassembly in their respective dedicated locations of inside and outside the door. In addition, for security reasons, the two mounting screws must always enter the assembly from inside the door to prevent unauthorized dismantling of the assembly from outside the door. Therefore, the cassettes must be disassembled so that the housing of the cassette which was originally inside the door will remain in that location after the reversing procedure has been completed.

Due to the arrangement of the components within the cassette, including the preloading of the springs, it is a difficult and tedious task to disassemble and reassemble the cassettes at the user site.

Thus, there is a need for a spring cassette of generally universal construction which can be interchanged with the cassette on the opposite side of the door when reversing the inside-outside arrangement of the door without removal of the spring from the cassette housing.

SUMMARY OF THE INVENTION

In view of the foregoing problem, it is an object of this invention to provide a cylindrical lock assembly which includes spring cassettes that are interchangeable with relative ease.

Another object of this invention is to provide a cylindrical lock assembly which includes spring cassettes that are constructed generally identically for mounting in the same fashion from each side of the door.

With these and other objects in mind, this invention contemplates a cylindrical lock assembly mountable on a door which includes a latchbolt and a mechanism for moving the latchbolt between a latched position and an unlatched position. A pair of sleeves extend from opposite sides of the mechanism and are attached thereto for operating the mechanism upon rotation of the sleeves. A pair of operators are mounted on the sleeves for facilitating selective rotation of the sleeves. A pair of springs are mounted on the pair of sleeves for developing a spring return force when the operators are moved from a home position to facilitate the return of the operators to the home position when the operators are released. A first housing means is provided for supporting one of the pair of springs on either side of the door. A second housing means identical in structure to the first housing means is provided for supporting the other of the pair of springs on either side of the door.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
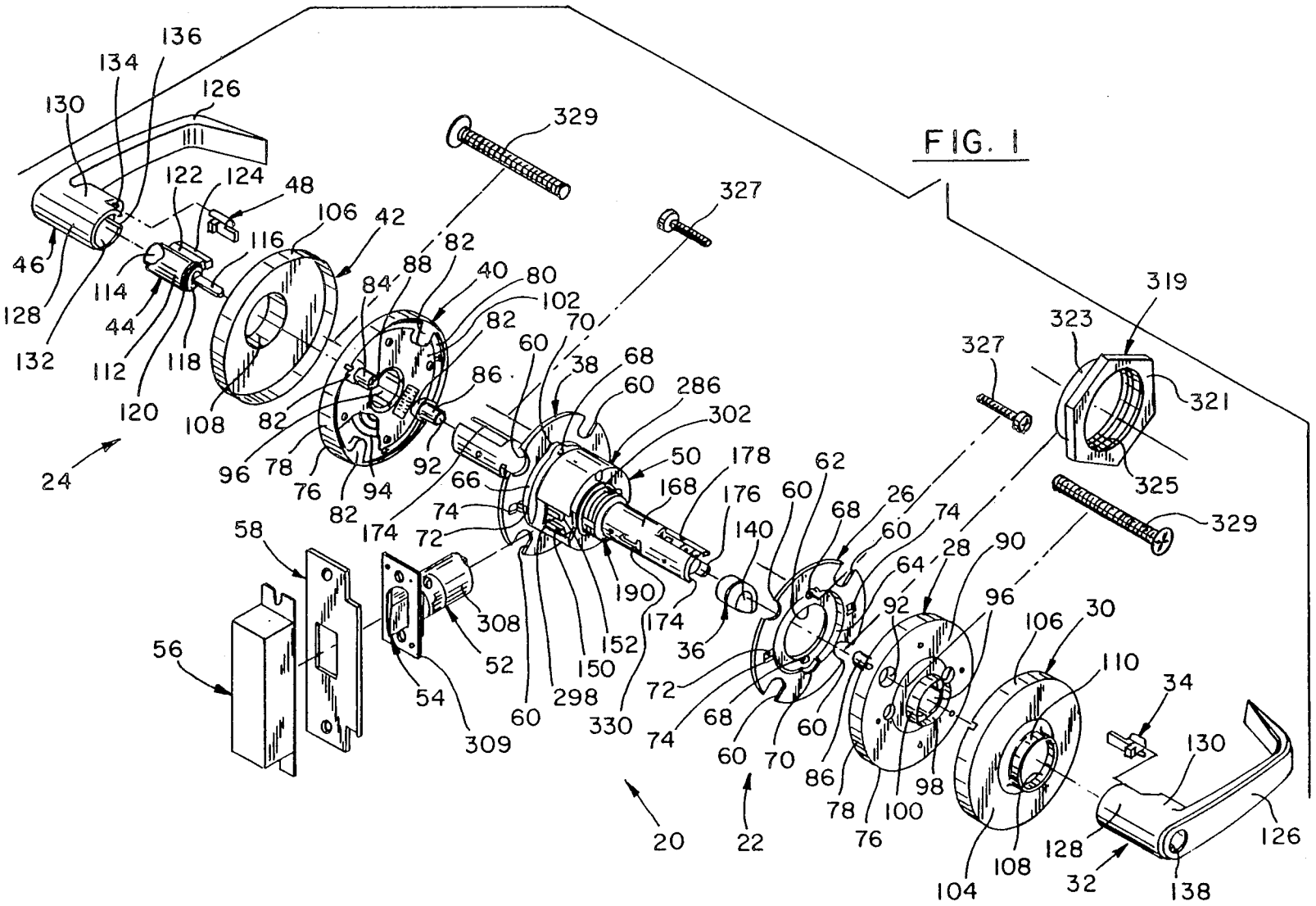
FIG. 1 is and exploded perspective view of a cylindrical lock assembly embodying certain principles of the invention.

As illustrated in FIG. 1, a cylindrical lock assembly 20 includes an inside subassembly 22 and an outside subassembly 24. The inside subassembly 22 includes a rose liner 26, a return spring cassette 28, a rose 30, a lever 32, a lever insert 34 and a turn button 36. The outside assembly 24 includes a rose liner 38, a return spring cassette 40, a rose 42, a cylinder lock 44, a lever 46 and a lever insert 48.

A chassis 50 is located between the inside subassembly 22, and the outside subassembly 24. A latch assembly 52 is positioned for operable attachment to chassis 38 and includes a latchbolt 54 which extends outwardly from the latch assembly in an extended or latched position in a direction away from the chassis 50. A strike box 56 and a strike 58 are mounted in a door frame (not shown) in cooperation with the cylindrical lock assembly 20.

Rose liners 26 and 38 are each formed in a circular configuration with four equally spaced slots 60 in the periphery thereof. Each of the liners 26 and 38 are formed with an axial opening 62, as illustrated with respect to liner 26, around which is formed a circular depression 64 on one side thereof and which appears as a protruding section 66 on the opposite side thereof as illustrated with respect to rose liner 38. A pair of screw holes 68 are formed in the depression 64 and through the protruding section 66 with clearance walls 70 formed therearound. A pair of tabs 72 are formed by punching holes 74 through the rose liners 26 and 38 with the tabs extending toward the other rose liners.

Cassettes 28 and 40 each include a circular housing 76 formed with a side wall 78 to form a dish-like cavity 80. Four equally spaced pads 82 are formed in the cavity and extend radially inwardly from side wall 78. The pads 82 are formed with an exterior configuration which is consistent with the shapes of slots 60 of rose liners 26 and 38. A pair of posts 84 and 86 are formed on two oppositely spaced pads 82 and extend outwardly from cavity 80. Post 84 is formed with an axial hole 88 which is threaded and extends through the post but does not extend through an outer face 90 which is illustrated on cassette 28. Post 86 is formed with an unthreaded hole 92 which extends through outer face 90.

A coil or torsion spring 94 and a lever arbor 96 are positioned in a concentric axial arrangement within cavity 80 so that the arbor extends into and partially through an axial opening 98 formed through outer face 90 and a hub 100 which extends outwardly from the outer face. Also, arbor 96 is mounted for rotary movement relative to housing 76. An outer end of spring 94 is attached to an adjacent portion of cavity 80 to preclude movement of the outer end. An inner end of spring 94 is attached to arbor 96 for movement with the arbor thereby allowing compression of the coil spring. A cover 102 is positioned within cavity 80 and over coil spring 94 and arbor 96 and is fastened to housing 76 to retain the spring and arbor in the concentric and axial arrangement within the cavity.

Roses 30 and 42 are each formed with a circular face 104 and a side wall 106. An axial opening 108 is formed through the face 104 and extends through a hub 110 which extends outwardly from the face.

Cylinder lock 44 includes a cylinder shell 112 with a central axial opening for receiving a cylinder plug 114. A tailpiece 116 extends axially from one end of plug 114 and though a tailpiece anchor plate 118 which is held with shell 112 by a threaded cap 120. A tumbler supporting rib 122 is formed integrally with shell 112 and extends laterally therefrom. A tumbler cover 124 is positioned over the outer portion of rib 122 to contain pin tumblers which are contained within the rib in alignment with mating portions of plug 114 to provide a key-operated locking facility.

Levers 32 and 46 each include a handle 126 which is formed integrally with a hub 128. A protrusion 130 is formed integrally with handle 126 and hub 128 at the inner corner of the juncture of the handle and hub. Hub 128 is formed with an axial opening 132 which communicates with an opening 134 formed in protrusion 130. Further, a slot 136 is formed in hub 128 which communicates with the outward end portion of axial opening 132 formed in the hub. An opening 138 is formed through handle 126 in axial alignment with, and in communication with, axial opening 132. Opening 138 is of a smaller diameter than the diameter of opening 132.

Turn button 36 is formed with a finger-grip end 140 at one end thereof which normally protrudes from opening 138 of lever 32. An attachment structure is formed at the opposite end of turn button 36 for engagement with elements within chassis 50 to facilitate locking of the latchbolt 54 in the extended position or latched by rotation of the button.

Figure 3:
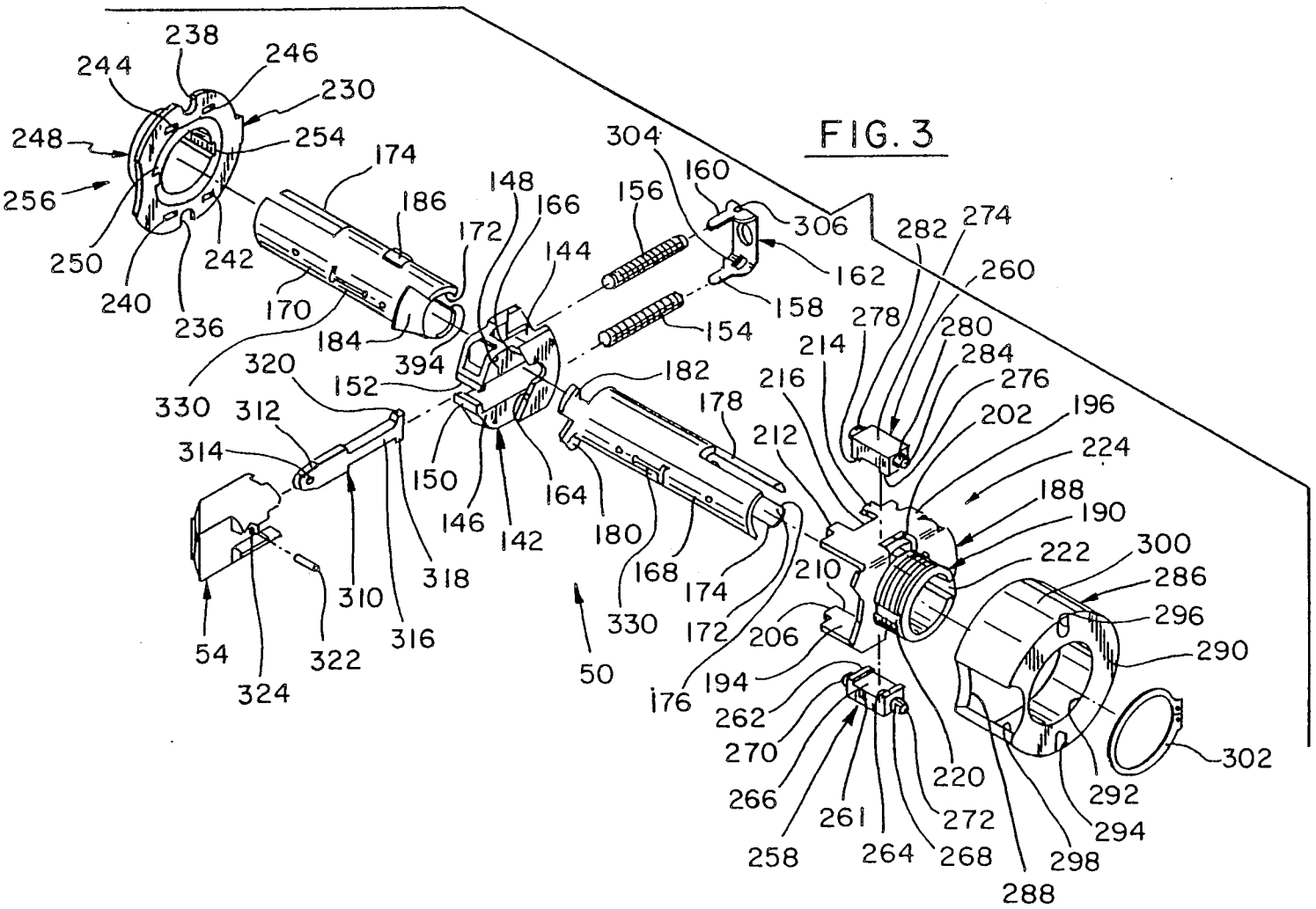
FIG. 3 is an exploded perspective view of a chassis of the cylindrical lock assembly of FIG. 1.

Referring now to FIGS. 1 and 3, chassis 50 includes a retractor 142 which is formed with a rear support 144 and a pair of vertically spaced, horizontally extending arms 146 and 148. The facing ends of arms 146 and 148 are formed with lips 150 and 152, respectively. A pair of pockets (not shown) are formed in the rear of support 144 to receive one end of a pair of compression springs 154 and 156. The opposite ends of springs 154 and 156 are positioned over a pair of spaced fingers 158 and 160, respectively, of an integrally formed retainer 162. Retractor 142 is formed with a pair of cam surfaces 164 and 166 on one side thereof. A similar pair of cam surfaces (not shown) are formed on the opposite side of retractor 142.

A pair of rollbacks or sleeves 168 and 170 are each formed with an axial through hole 172 and with slots 174, 176, and 178 in one end thereof. Slots 174 and 178 are aligned vertically and slot 176 is located on one side of the sleeves 168 and 170 angularly spaced by ninety degrees from slots 174 and 178. Sleeve 168 is formed with a pair of camming elements 180 and 182 which are formed by rolling back portions of the sleeve which extend from the end of the cylindrical portion of the sleeve. A single camming element 184 is formed from sleeve 170. A tab 186 protrudes outwardly from an intermediate portion of each of the sleeves 168 and 170. As illustrated in FIG. 3, tab 186 protrudes from an upper surface of sleeve 170. Tab 186 of sleeve 168 extends from a lower surface of the sleeve but is not visible in FIG. 3.

Figure 4:
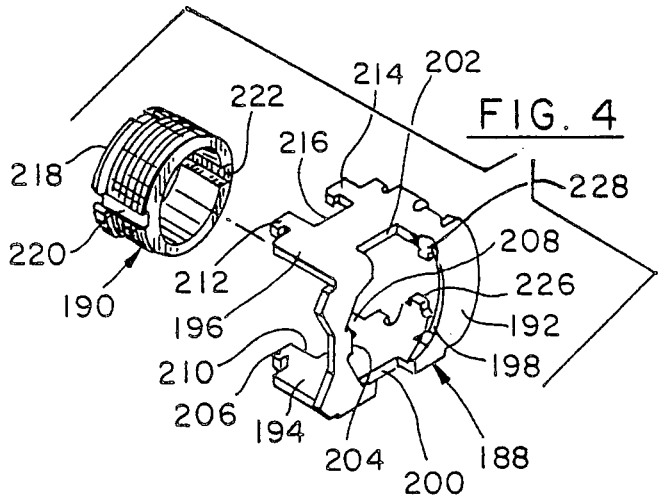
FIGS. 4 and 5 are exploded perspective views of components of the chassis of FIG. 3.

Referring to FIGS. 3 and 4, chassis 50 further includes a case 188 and a sleeve 190. Case 188 is formed in a U-shaped configuration having a base 192 and a pair of legs 194 and 196 formed integrally with the base. Base 192 is formed with an opening 198 which communicates with a pair of notches 200 and 202 formed in the legs 194 and 196, respectively, at the junctures of the legs and the base. Base 192 is further formed with a tab 204 which protrudes slightly into opening 198. Leg 194 is formed with a pair of spaced, hook-like tabs 206 and 208 at the free end of the leg with a notch 210 formed in the free end of the leg between the tabs. In similar fashion, leg 196 is formed with a pair of spaced, hook-like tabs 212 and 214 at the free end of the leg with a notch 216 formed in the free end of the leg between the tabs.

Sleeve 190 is formed in a cylindrical shape with a flange 218 at one end thereof which has a diameter greater that the diameter of the opening 198 of case 188. The periphery of sleeve 190 is threaded and is formed with a longitudinal slot 220 therein. Further, a longitudinal slot 222 is formed in the inner wall of sleeve 190.

As illustrated in FIG. 3, the threaded portion of the sleeve 190 is inserted between legs 194 and 196 and through opening 198 of case 188 with flange 218 resting against the inner surface of base 192 adjacent the opening. In this arrangement, the threaded portion of the sleeve 190 extends from the outer surface of base 192 and combines with case 188 to form a case assembly 224.

Referring again to FIG. 4, an inwardly turned tab 226 is formed along a side edge of leg 194 of case 188. In similar fashion, an inwardly turned tab 228 is formed along a side edge of leg 196 of case 188 in spaced and aligned relation with tab 226.

Figure 5:
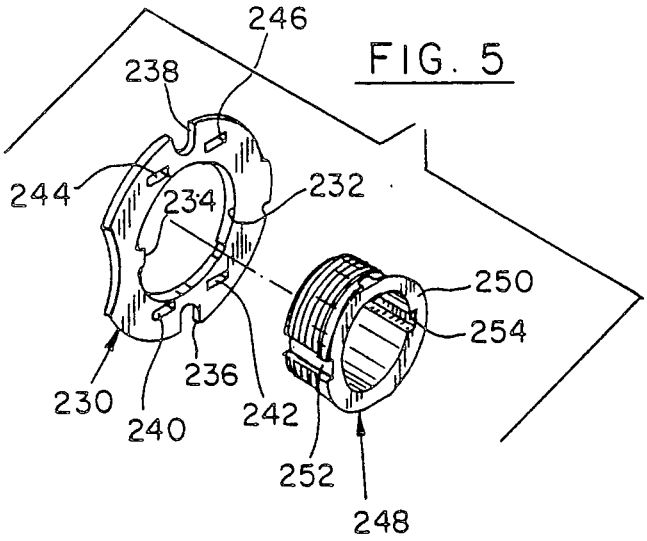

Referring to FIGS. 3 and 5, a cap 230 in generally circular and is formed with a central opening 232 and a tab 234 protruding inwardly into the opening. A pair of diametrically opposed slots 236 and 238 are formed in the periphery of cap 230. Four spaced through holes 240, 242, 244 and 246 are formed in cap 230. A sleeve 248 is of cylindrical shape and is formed with a flange 250 at one end thereof which has a diameter larger than the diameter of opening 232. The peripheral surface of sleeve 248 is threaded and is formed with a longitudinal slot 252. A longitudinal slot 254 is formed in the inner wall of sleeve 248. As illustrated in FIG. 3, cap 230 and sleeve 248 are assembled to form a cap assembly 256 with the threaded portion of the sleeve inserted through opening 232 and extending outwardly from the cap. In this position, flange 250 is flush against the adjacent surface of cap 230.

As illustrated in FIG. 3, chassis 50 further includes a pair of spaced mounting blocks 258 and 260. Block 258 is formed with a central body 261 and a pair of spaced pedestals 262 and 264 which extend outwardly from opposite ends of a surface 266 of the body. A pair of posts 268 and 270 extend from opposite ends of body 261 of block 258 with a threaded hole 272 extending longitudinally through the body and the posts. Block 260 is formed in identical fashion with a body 274 and spaced pedestals 276 and 278 extending from one surface of the body. A pair of posts 280 and 282 extend from opposite ends of the body 274 and a threaded hole 284 extends longitudinally through the body and the posts.

Referring again to FIG. 3, chassis 50 includes a housing 286 which is generally of cylindrical shape. One side 288 of housing 286 is completely open while the other side 290 is formed with a smaller opening 292. Also, side 290 is formed with spaced holes 294 and 296. An opening 298 is formed in the peripheral surface 300 of housing 286. Chassis 50 further includes a retaining ring 302.

In assembly of the components of chassis 50, sleeves 168 and 170 are positioned so that camming elements 180 and 182 are located between cam surfaces 164 and 166 and camming element 184 is located adjacent to an associated cam surface on retractor 142. The forward ends of springs 154 and 156 are positioned in mating pockets of retractor 142 and the rear ends of the springs are positioned over fingers 158 and 160. This forms a retractor subassembly.

The retractor subassembly is then located so that sleeve 168 is positioned through and extends outwardly from the axial opening of sleeve 190. In this position, retractor 142 is located in the space between legs 194 and 196 and close to the inner surface of base 192. Retainer 162 is formed with a pair of spaced slots 304 and 306 which rest over tabs 226 and 228 of case 188 thereby placing springs 154 and 156 in a contained position for subsequent compression.

Cap assembly 256 is then positioned over sleeve 170 with tabs 206, 208, 212 and 214 of case 188 being located in and through holes 240, 242, 244, 246, respectively.

In this fashion, retractor 142 the inward ends of sleeves 168 and 170, spring 154 and 156 and retainer 162 are contained within the enclosure formed by the securance of cap assembly 256 with case 188.

Pedestals 262 and 264 of block 258 are positioned in notches 200 and 210, respectively of case 188 and pedestals 276 and 278 of block 260 are positioned in notches 202 and 216, respectively, of the case. Housing 286 is then manipulated so that sleeve 168 extends outwardly from opening 292 of the housing and sleeve 170 extends outwardly from open side 288 of the housing. In this arrangement, the secured cap assembly 256 and case 188, and the elements contained therein as noted above, are located within housing 286 with lips 150 and 152 of retractor 142 exposed through opening 298 of the housing.

Retaining ring 302 is positioned about the threaded portion of sleeve 190 and against side 290 of housing 286 to retain the elements of chassis 50 in the assembly as described above.

It is noted that in the assembled chassis 50, the threaded holes 272 and 284 of blocks 258 and 260, receptively, are aligned with slots 236 and 238, respectively, of cap assembly 256 and holes 294 and 296, respectively, of housing 286. Also, as illustrated in FIG. 1, rose liner 38 is positioned over sleeve 170 and the threaded portion of sleeve 248 of cap assembly 256 and located adjacent the open side 288 of housing 286. In this position, screw holes 68 of rose liner 38 are aligned with the threaded holes 272 and 284 of blocks 258 and 260, respectively. Screws can then be placed through screw holes 68 of rose liner 38 and threadedly secured within one end of holes 272 and 284 of blocks 258 and 260, respectively, to secure the rose liner with the chassis 50.

Referring now to FIGS. 1 and 3, latch assembly 52 includes a latch case 308 which is secured at one end thereof to a front plate 309. Latchbolt 54 is contained partially within case 308 and extends outwardly therefrom to the extended position and through an opening in front plate 309. It is noted that latchbolt 54 is retractable into case 308 to a retracted or unlatched position. Therefore, latchbolt 54 is movable between the extended or latched position and the retracted or unlatched position. As viewed in FIG. 3, a tail piece or link 310 is formed with a head 312 and lateral through hole 314 at one end thereof. Link 310 is formed with a T-shaped tail 316 at the other end thereof and includes cross arms 318 and 320. Head 312 is located within a slot (not shown) formed in rear of latchbolt 54 and is pivotally secured thereto by a pin 322 which is inserted through aligned holes, including a hole 324, formed in the latchbolt and hole 314 formed in the head.

Head 312 and the portion of latchbolt 54 to which the head is attached are contained within case 308. Tail 316 extends from the rear of case 308 and is designed to be positioned eventually through opening 298 of housing 286 with cross arms 318 and 320 being located behind lips 150 and 152 of retractor 142. In this fashion, upon rotation of sleeves 168 or 170, camming elements 180 and 182 Will engage cam surfaces 164 and 166 to urge retractor 142 rearwardly against the biasing of springs 154 and 156. As retractor 142 is moved rearwardly, link 310 is pulled with the retractor to withdraw latchbolt to the retracted position.

Figure 2:
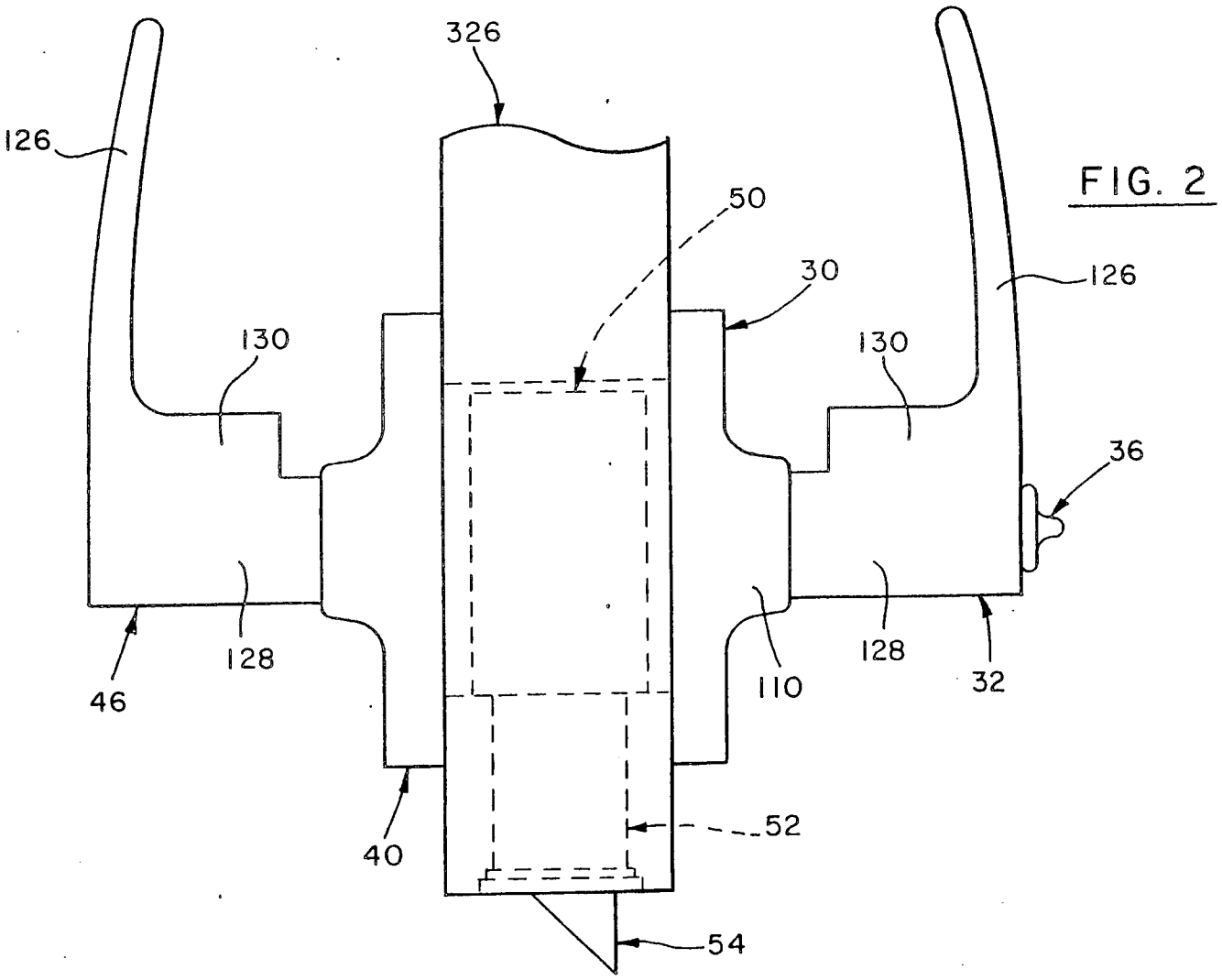
FIG. 2 is a plan view of the cylindrical lock assembly of FIG. 1 assembled with, a door.

In further assembly of the components of cylindrical lock assembly 20 of FIG. 1, case 308 of latch assembly 52 is positioned within an opening (not shown) in the edge of a door 326 (FIG. 2) which communicates with a larger door opening which later receives chassis 50. Chassis 50 with attached rose liner 38 is then inserted through the larger door opening in door 326 where the door opening is slightly larger in diameter than the diameter of housing 286. As chassis 50 is moved into the larger opening, the chassis engages and becomes attached to the tail-end of latch case 308. Also, tabs 72 of rose liner 38 are moved into notches in the door and the rose liner is flush with the adjacent surface of the door. In this position, housing 286 is located within the door opening and sleeves 168 and 170 extend from opposite sides of the door. Tail 316 of link 310 is then attached to retractor 142 in the manner previously described and plate 309 is secured to the edge of door 326 in a conventional manner. Rose liner 26 is then moved over sleeve 168 and toward door 326 whereby tabs 72 are moved into notches formed in the adjacent surface of the door and screw holes 68 are aligned with the other ends of threaded holes 272 and 284 of blocks 258 and 260, respectively. Thereafter, a hex nut 319 having a hex flange 321 and a sleeve section 323 with a threaded axial hole 325 is threadedly mounted onto sleeve 190 until the hex flange seats in the depression 64 of rose liner 26. Screws, such as screws 327, are then positioned through holes 68 of rose liner 26 and threadedly into holes 272 and 284 to secure the rose liner in the assembled position. In this position, the head of screw 327 is located adjacent the periphery of an adjacent flate of hex flange 321 so that the screw head prevents the hex nut 319 from loosening.

It is noted that in assembling rose liners 26 and 38 in the manner described above, slots 60 of rose liner 26 are aligned with corresponding slots 60 of rose liner 38.

Cassettes 28 and 40 are then positioned over sleeves 168 and 170 so that tabs 186 are positioned within longitudinal slots formed in the cylindrical opening of arbors 96 of the cassettes. In this manner, arbors 96 are keyed to sleeves 168 and 170 to rotate upon rotation of the sleeves. As cassettes 28 and 40 are moved over sleeves 168 and 170, pads 82 of the cassettes are located in respective slots 60 of rose liners 26 and 38, respectively. As cassettes 28 and 40 are assembled in this fashion, posts 84 and 86 of each of the cassettes, are located with corresponding openings (not shown) in door 326. In this arrangement, post 84 of cassette 40 is axially aligned with post 86 of cassette 28 and post 86 of cassette 40 is axially aligned with post 84 of cassette 28. The threaded end of a screw 329 is placed through unthreaded hole 92 of post 86 from the outer face 90 of cassette 28 and into threaded hole 88 of post 84 of cassette 40. In similar fashion, the threaded end of another screw 329 is placed through unthreaded hole 92 of post 86 from the outer face of cassette 40 and into threaded hole 88 of post 86 of cassette 28. The screws 329 are then tightened to draw cassettes 28 and 40 to a secure position on opposite sides of door 326 whereby the heads of the screws come to rest in countersunk holes in the outer faces 90 of the cassettes in alignment with post holes 86.

Roses 30 and 42 are then positioned over cassettes 28 and 40, respectively, and are held in assembly by a dimple and detent arrangement (not shown) formed in complimentary fashion in the roses and cassettes. Other arrangements could be used to secure roses 30 and 42 with cassettes 28 and 40, respectively, such as, for example, a dimple and L-shaped slot arrangement (not shown). One end of turn button 36 is then positioned within sleeve 168 to mate with conventional locking facilities within chassis 50 to permit selective locking of latchbolt 54 in the extended position upon turning of the turn button. Insert 34 is positioned within an inward opening of protrusion 130 of lever 32. Thereafter, opening 138 of lever 32 is positioned onto and over sleeve 168 so that finger-grip end 140 of turn button 36 extends through the outward end of opening 138.

It is noted that turn button 36 is spring-biased outwardly from sleeve 168 but is formed with a flange which precludes movement of the button axially outwardly from opening 138 other than the extended finger-grip end 140. It is further noted that a pair of spaced longitudinal ribs are formed radially inwardly within opening 132 of lever 32 which fit into slots 174 and 178 of sleeve 168 to facilitate rotation of the sleeve upon actuation of the lever. Since arbor 96 is keyed to sleeve 168 by tab 186 on the underside of the sleeve, spring 94 will be compressed upon actuation of lever 32, by an operator. Compressed spring 94 will provide the force to return lever 32 to its home position upon release thereof by the operator. Opening 132 of lever 32 is formed with a transverse slot or depression in hub 128 and is positioned for alignment with a slot 330 formed in sleeve 168. A spring-biased detent or catch plate extends through slot 330 and into the depression of opening 132 to retain lever 32 with sleeve 168. A small hole extends from the outer surface of hub 128 and communicates with the depression in opening 132 to facilitate insertion of an implement to retract the spring-biased detent and permit extraction of lever 32 from the assembly.

Cylinder lock 44 is positioned within the axial opening 132 of hub 128 of lever 46 whereby the rib 122 and cover 124 are moved through and beyond lever slot 136 and into opening 134 of protrusion 130. Insert 48 is then assembled with lever 46 so that a portion of the insert covers slot 136 and another portion covers opening 134. This provides an exterior cover for slot 136 and opening 134 which blends structurally with and follows the contours of adjacent exterior portions of hub 128 and protrusion 130.

Lever 46, with cylinder lock 44 and insert 48 assembled therewith, is then manipulated to position axial opening 132 over sleeve 170. Ribs which are formed within opening 132 are moved into slot 174 of the sleeve and a slot of the sleeve which is diametrically opposite slot 174. Further, rib 122 and cover 124 of lock assembly 44 are moved into a slot on the far side of sleeve 170 equally spaced from slot 174 and the diametrically opposite slot. Eventually, a portion of the spring-biased detent or catch plate extends through slot 330 (FIG. 3) and sleeve 170 moves into a transverse slot or depression in hub 128 of lever 46 to retain the lever with sleeve 170 to complete assembly of cylindrical lock assembly 20. It is noted that sleeve 170 is formed with the same three-slot arrangement as sleeve 168 which is formed with slots 174, 176 and 178. Sleeves 168 and 170 are thereby interchangeable by merely rotating the sleeves vertically through one hundred and eighty degrees whereby slot 174 is on the bottom for the position of sleeve 168 and is on the top for the position of sleeve 170.

Figures 6, 7:
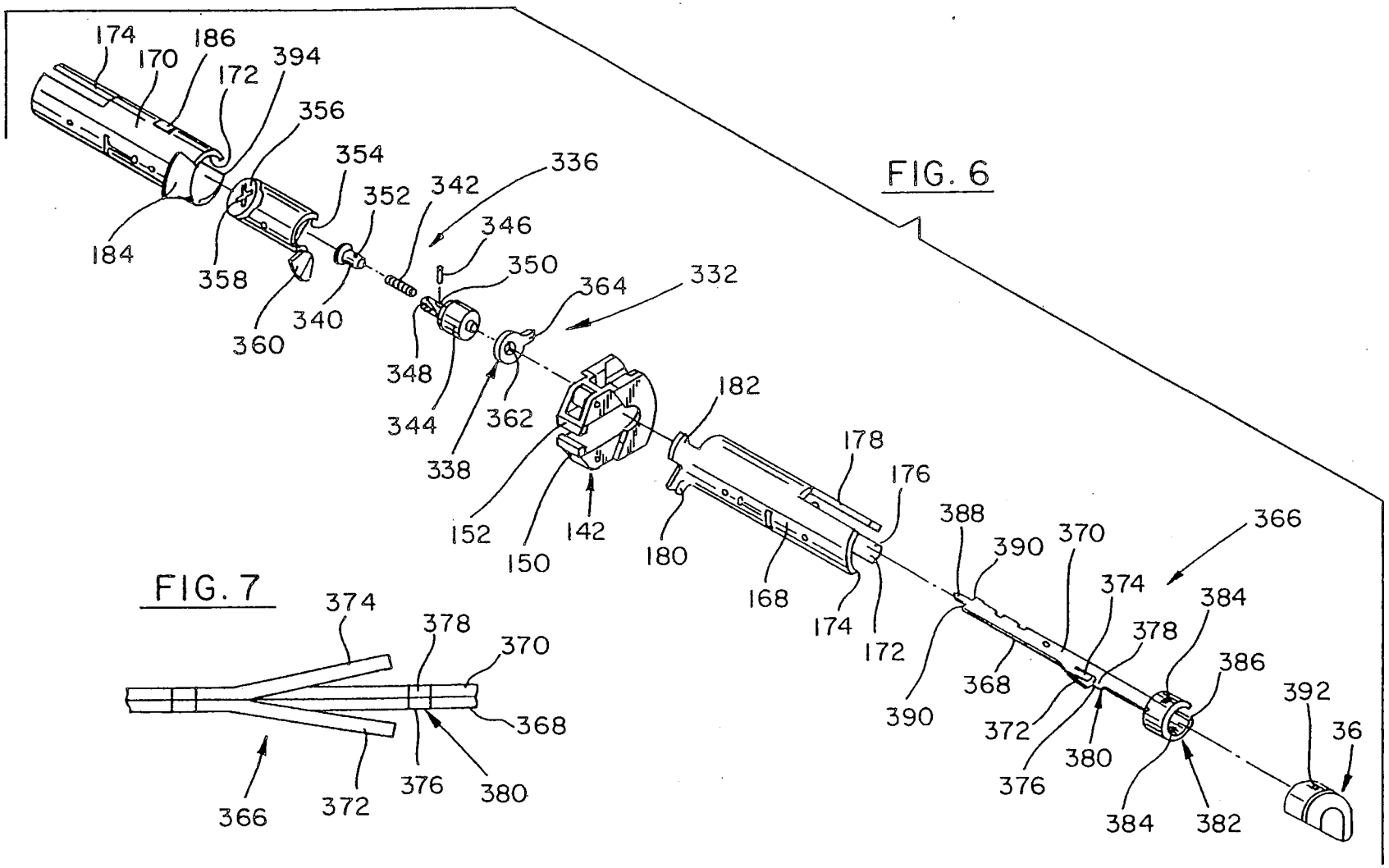
FIG. 6 is an exploded perspective view of a locking arrangement which can be used with the cylindrical lock assembly of FIG. 1.
FIG. 7 is a partial plan view of a linkage bar of the locking arrangement of FIG. 6.

Referring to FIG. 6, a lock mechanism 332 is illustrated with a portion of the elements of FIG. 1 to show an embodiment of a lock mechanism which functions with cylindrical lock assembly 20. It is to be understood that other lock mechanisms could be used without departing from the spirit and scope of applicants' invention.

As illustrated, sleeves 168 and 170 are located on opposite sides of retractor 142 of chassis 50. Interposed between sleeve 170 and retractor 142 are an auxiliary sleeve or rollback 334, a plunger assembly 336 and a locking dog 338. Plunger assembly 336 includes a plunger head 340, a spring 342, a plunger body 344 and a pin 346. Spring 342 and head 340 are inserted into an opening 348 formed axially in one end of body 344. Pin 346 is then inserted through an elongated slot 350 and into a hole 352 formed in head 340. Spring 342 normally urges head 340 outwardly from opening 348 but is prevented from moving out of the opening by virtue of the assembly of pin 346. Also, since pin 346 is located within elongated slot 350, head 340 is permitted to travel axially with respect to opening 348 within the defined limits of the length of the slot.

Auxiliary sleeve 334 is formed with an axial opening 354 at one end thereof and a cover 356 at the other end thereof which is formed with a centrally located cross slot 358 located for reception of tailpiece 116 of cylinder lock 44. A camming element 360 is formed at the open end of auxiliary sleeve 334. Locking dog 338 is formed with an axial hole 362 and an ear 364 which extends radially from the hole. The free end of ear 364 is always contained within slot 254 of sleeve 248 (FIG. 3) to prevent rotation of dog 338 but to permit axial movement thereof.

A linkage bar 366 is positioned on the outboard side of sleeve 168 in axial alignment therewith as viewed in FIG. 6. Linkage bar 366 is formed by riveting together two flat strips 368 and 370 (FIG. 7) of metal. Strips 368 and 370 are formed with spring-biased fingers 372 and 374, respectively, along an intermediate edge, which flare away from the assembled strips as shown in FIG. 7. Strips 368 and 370 are also formed with tabs 376 and 378, respectively, which combine in assembly to form tab 380 of linkage bar 366. A cup-shaped cap 382 is attached to the outboard end of linkage bar 366 and is formed with a pair of oppositely spaced holes 384 and a slot 386. The opposite end 388 is reduced in width to form shoulders 390.

Turn button 36 is formed with a pair of oppositely spaced inwardly projecting tabs 392. Turn button 36 is positioned over cap 382 so that tabs 392 are placed into holes 384 to retain the button with the cap and with linkage bar 366.

In assembly, linkage bar 366 with turn button 36 are moved axially so that end 388 is first moved through sleeve 168, retractor 142 and opening 362 of dog 338. Opening 362 of dog 338 is designed to permit entry of end 388 and to permit the end and bar 366 to be rotated independently of the dog when turn button 36 is rotated and to permit shoulder 390 to move the dog axially. Plunger assembly 336 is inserted into opening 354 of auxiliary sleeve 334 which, in turn is positioned within opening 172 of sleeve 170. In this position, camming element 360 of auxiliary sleeve 334 is located adjacent to camming element 184 of sleeve 170.

Linkage bar 366 is moved further inwardly to move dog 338 further within sleeve 248 (FIG. 3) to a position in the vicinity of opening 172 of sleeve 170 adjacent camming element 184. In this position ear 364 of dog 338 is located for selective positioning into a slot 394 formed in sleeve 170. Plunger body 344 is pressing against end 388 of linkage bar 366 and dog 338 to provide spring biasing of the linkage bar and turn button 36 by virtue of spring 342.

As linkage bar 366 is moved through sleeve 168, fingers 372 and 374 move through a passage internally of the sleeve where they are pressed generally together and then spring back to the position shown in FIG. 7. This permits the free ends of fingers 372 and 374 to be positioned to engage shoulders within sleeve 168 to preclude complete retraction of linkage bar 366 from within the sleeve but to permit limited axial movement therein.

When linkage bar 366 is in the unlocked position, the bar is prevented from being rotated by a first tab blocking structure within sleeve 168 which prevents tab 380 from moving in an arcing direction. In this position, spring 342 is biasing dog 338 so that ear 364 is outside of slot 394 of sleeve 170 whereby the sleeve can be rotated by operation of lever 46. This results in movement of latchbolt 54 from the latched position to the unlatched position.

When it is desired to lock assembly 20 by use of turn button 36, the button is pushed axially inward whereby tab 380 clears the first tab blocking structure within sleeve 168. Turn button 36 can now be rotated to move tab 380 through an arc to a position on the inboard side of a second tab blocking structure within sleeve 168. When turn button 36 is released, tab 380 engages the second tab blocking structure and is pressed against the structure by spring 342 to retain linkage bar 366 and the turn button in this position.

As linkage bar 366 is moved inwardly and rotated as described above, shoulders 390 move dog 338 further through sleeve 248 (FIG. 3) to a position where ear 364 is located in slot 394 of sleeve 170. This prevents sleeve 170 from being turned whereby assembly 20 is the locked condition with respect to operation of the assembly by use of outside lever 46.

As previously described, cylinder lock 44 includes a tailpiece 116 (FIG. 1) which extends toward the inboard side of assembly 20. In assembling the components of assembly 20, tailpiece 116 is inserted into slot 358. When cylinder lock 44 is in the locked condition, tailpiece 116 is prevented from turning and assembly 20 is thereby locked from the outside. In this condition, latchbolt 54 can not be moved from the latched position by operation of outside lever 46. When a key is inserted into cylinder lock 44 and lock tumbler pins are thereby appropriately aligned, the key can be turned which results in turning of tailpiece 116. This turns auxiliary sleeve 334 whereby camming element 360 is moved to move retractor 142 and thereby retract latchbolt 54.

Figures 8, 9:
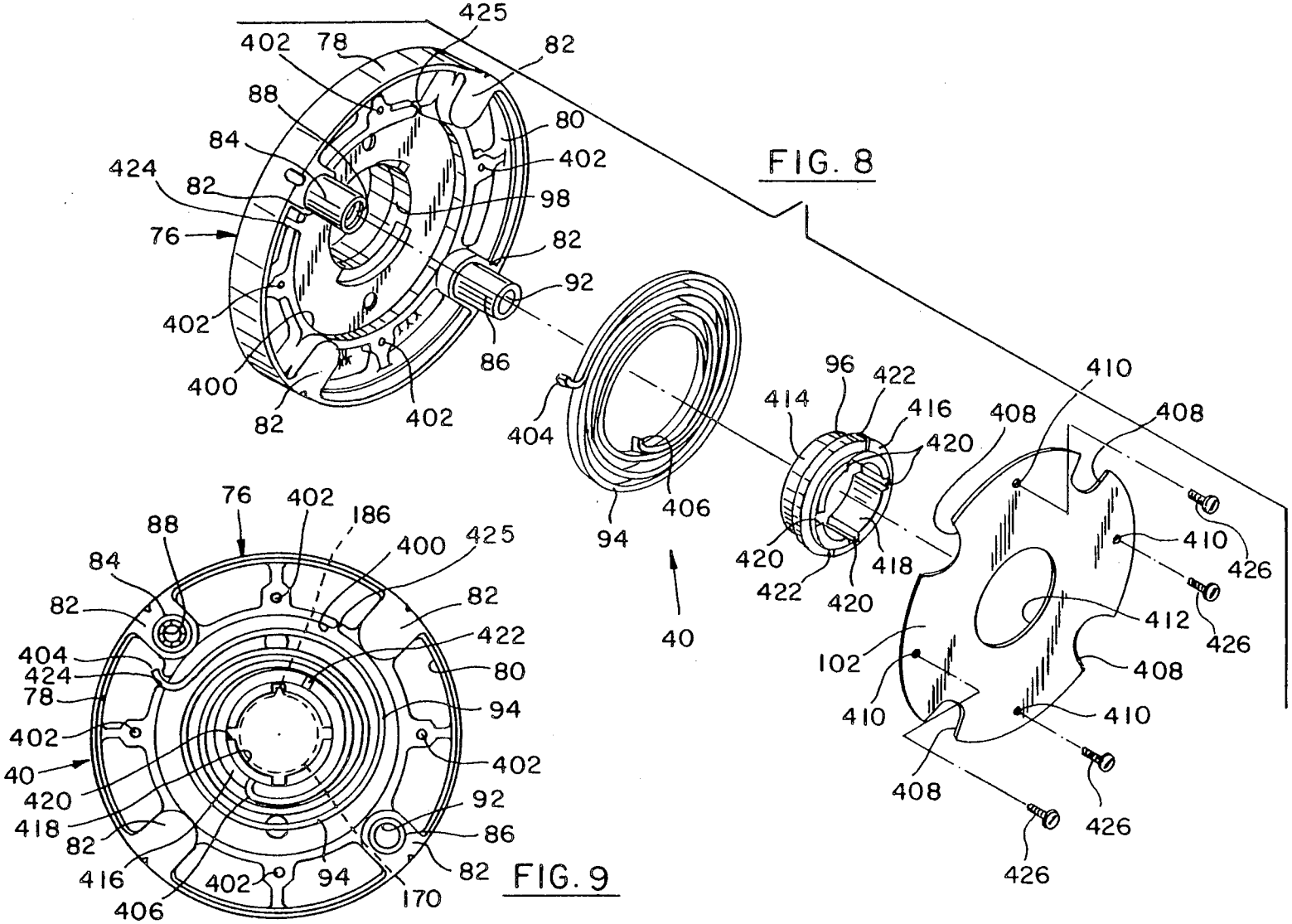
FIG. 8 is an exploded perspective view of a spring cassette embodying certain principles of the invention.
FIG. 9 is a front view of the spring cassette of FIG. 8 with a cover removed to show the interior of the cassette.

Referring to FIGS. 8 and 9, cassette 40 which is identical to cassette 28 includes housing 76 which is formed further with a well 400 in the base of cavity to receive coil or torsion spring 94. Further, cassette 40 is formed with four equally spaced threaded holes 402 within cavity 80. Spring 94 is formed with a bent outward end 404 and a bent inward end 406. Cover 102 is formed with four equally spaced slots 408, four through holes 410 and an axial hole 412. Arbor 96 is formed with a sleeve 414, a flange 416 and an axial opening 418. Arbor 96 is further formed with four equally spaced slots 420 extending in an axial direction within the wall of opening 418. Further, a pair of slots 422 extend through flange 416. Also, a pair of slots 424 and 425 are formed in the side wall of well 400.

Sleeve 414 of arbor 96 is moved through well 400 and into opening 98 of housing 76 until flange 416 seats in the well. As noted above, arbor 96 is mounted for rotational movement relative to housing 76. Coil spring 94, preloaded to a specified tension, is then positioned within well 400, with outward end 404 being positioned in slot 424 and inward end 406 being positioned in one of the pair of slots 422 formed in flange 416 of arbor 96.

With the preloaded tension, spring 94 will support lever 46 in its rest or home position. Cover 102 is then positioned within cavity 80 with slots 408 being located about pads 82 with posts 84 and 86 extending as illustrated in FIG. 1. Holes 410 of cover 102 align with threaded holes 402 of housing 76. Screws 426 are located through cover holes 410 and threadedly mounted in housing holes 402 to secure cover 102 with housing 76 to capture and retain spring 94 and arbor 96 within the housing.

It is noted that, while the elements of cassettes 28 and 40 are identical, the springs 94 are wound in different directions to accommodate left-handed and right-handed assemblies on door 326. Thus, end 404 of spring 94, as mounted in cassette 28, is located in slot 425.

As noted above, cassettes 28 and 40 are assembled on opposite sides of door 326 by positioning the axial openings 418 of the respective arbors 96 over sleeves 168 and 170. In this arrangement, tab 186 of sleeve 170 is located within the upper slot 420 of arbor 96 while the corresponding tab on the underside of sleeve 168 is located within the bottom slot 420 of the respective arbor 96.

Post 86 of cassette 28 is located within an opening in door 326 in direct and open axial alignment with post 84 of cassette 40 also located within the door opening. In like manner, post 86 of cassette 40 is in direct and open axial alignment with post 84 of cassette 28 both of which are located within the opening of door 326. As noted above, the hole 88 of post 84 of each of the cassettes 28 and 40 is threaded while holes 92 of posts 86 are not threaded. Also, posts 84 and 86 of cassette 28 are located within respective slots 68 of rose liner 26 while posts 84 and 86 of cassette 40 are located within respective slots 68 of rose liner 38.

A first of the screws 329 is positioned through unthreaded opening 92 in face 90 of cassette 28, through the opening of door 326 and into the threaded opening 88 of post 84 of cassette 40. A second of the screws 329 is positioned in similar fashion through unthreaded opening 92 from the outer face of cassette 40, through the opening in door 326 and is threadedly mounted in threaded hole 88 of post 84 of cassette 28. The two screws 329 are then tightened to firmly secure cassettes 28 and 40 in assembly with door 326, chassis 50 and rose liners 26 and 38.

As viewed in FIG. 9, sleeve 170 is illustrated in phantom with tab 186 thereof being located in the upper one of the four slots 420 of arbor 96. As sleeve 170 is rotated upon operation of lever 46 (FIG. 1), arbor 96 is rotated in a clockwise direction as viewed in FIG. 9 relative to housing 76. Since outward end 404 of spring 94 is fixedly secured to housing 76 and inward end 406 of the spring is secured to rotating arbor 96, the spring will be compressed. When lever 46 is released, the compressed spring 94 is released and returns to an uncompressed condition whereby the lever is returned to its home or rest position.

As noted above, cassette 28 is identical to cassette 40 except that spring 94 of cassette 28 is wound in the opposite direction as noted above and, therefore, operates in the same manner. It is further noted that only a single one of the screws 329 is positioned through the outer face 90 of each of the cassettes 28 and 40 for securance to the other cassette.

In conventional lever lock set assemblies, the spring of the cassette on one side of the the door, for example the inside, must be wound in a dedicated fashion in comparison to the spring on the other side of the door in order to compress the spring upon operation of the associated lever. In this context, the one side may be referred to as a right-handed side and the other is a left-handed side. Further, both mounting screws are typically mounted from the inside of the door and are threadedly fastened into threaded holes in the cassette mounted on the outside of the door.

When a user wishes to reverse the inside-outside arrangement of the door, the cassettes must be disassembled to remove the springs for reassembly in their respective dedicated locations of inside and outside the door. In addition, for security reasons, the two mounting screws must always enter the assembly from inside the door to prevent unauthorized dismantling of the assembly from outside the door. Therefore, the cassettes must be disassembled so that the housing of the cassette which was originally inside the door will remain in that location after the reversing procedure has been completed.

Due to the arrangement of the components within the cassette, including the preloading of the springs, it is a difficult and tedious task to disassemble and reassemble the cassettes at the user site.

When using cassettes 28 and 40 in a lever lock set, the cassettes can be removed from their original sides of door 326 and, without dismantling the cassettes, reassemble them on opposite sides of the door to effect a simple reassembly procedure. This is accomplished because of the manner in which the mounting screws 329 are assembled, that is, one screw is assembled from one side of door 326 and the remaining screw is assembled from the other side of the door.

Thus, cassettes 28 and 40 provide, in effect, a non-handed lever cylindrical lock trim which includes a common housing and an independent trim lever support spring mechanism which does not require disassembly to reverse the hand of the lock. The lock trim also provides additional support for sleeves 168 and 170 of chassis 50. Further, lock security is increased by the arrangement of mounting screws 329 in opposing fastening directions, that is, one screw from each door side. Also, lever sagging problems due to the previous necessity of disassembly of the springs, and the inability to preset the preloaded tension on site, has been eliminated.

If the single screw 329 which enters outside cassette 40 could be removed, the remaining screw which enters through inside cassette 28 is not accessible from outside of door 326 and, therefore, provides a secured arrangement which will discourage successful tampering.

Even though the manner of mounting a single one of the screws 329 from each side of door 326 provides a security arrangement, rose 42 is positioned over the single screw 329 at cassette 40 to provide an additional secured arrangement. This secured arrangement is further enhanced by the fact that rose 42 cannot be removed until lever 46 is removed which requires that cylinder lock 44 be unlocked by an authorized key.

In general, the above-described embodiment is not to be construed as limiting the breadth of the present invention Modifications, and other alternative constructions, will be apparent which are within the spirit and scope of the invention as defined in the appended claims.

What is claimed is:

1. A cylindrical lock assembly, which comprises:

a latchbolt;

a mechanism for moving the latchbolt between a latched position and an unlatched position;

a pair of sleeves extending from opposite sides of the mechanism and attached thereto for operating the mechanism upon rotation of the sleeves;

a pair of operators mounted on the sleeves for facilitating selective rotation of the sleeves;

a pair of springs mounted on the pair of sleeves for developing a spring return force when the operators are moved from a home position to facilitate the return of the operators to the home position when the operators are released;

a first cassette means for supporting one of the pair of springs on either side of the door;

a second cassette means identical in structure to the first cassette means for supporting the other of the pair of springs on either side of the door;

each of the first and second cassette means having a housing formed with a well for receipt of a respective spring of the pair of springs;

means formed in the housing for attachment of a first end of the respective spring to the housing and mountable on a respective sleeve of the pair of sleeves; and an arbor formed with a flange having a radial slot therein for attachment to the second end of the spring and an axial opening with a groove formed therein for engagement with the sleeve.

2. The cylindrical lock assembly as set forth in claim 1, wherein the housing has an outer face and an inner face which includes the well and which further comprises:

a first hole unthreaded and extending through the housing from the outer face to the inner face thereof; and a second hole formed in the inner face of the housing and formed with threads therein.

3. The cylindrical lock assembly as set forth in claim 2, which further comprises:

a first post formed with the housing and extending from the inner face having an unthreaded opening therethrough in communication with the first hole to provide an extension of the first hole beyond the inner face; and a second post formed with the housing and extending from the inner face having a threaded opening therethrough in communication with the second hole to provide an extension of the second hole beyond the inner face.

4. The cylindrical lock assembly as set forth in claim 3, which further comprises:

four equally spaced pads formed in the inner face of the housing adjacent the well, and the first post extending outwardly from a first of the four pads and the second post extending outwardly from a second of the four pads diametrically opposite the first pad.

5. The cylindrical lock assembly as set forth in claim 1, which further comprises:

a wall formed adjacent the well; and a pair of slots formed in spaced locations of the wall for optional receipt of the first end of the spring.

6. The cylindrical lock assembly as set forth in claim 1 wherein the springs are coil springs.

7. The cylindrical lock assembly as set forth in claim 1 which further comprises:

a pair of cover plates attached to the first and second cassette means to contain the pair of springs with the cassette means.

8. The cylindrical lock assembly as set forth in claim 1, which further comprises:

each of the first and second cassette means supporting the respective spring of the pair of springs on one side thereof;

each of the first and second cassette means formed with a first unthreaded hole extending completely through the cassette means from the one side to an opposite side;

each of the first and second cassette means formed with a second threaded hole extending from the one side into the cassette means; and the first cassette means being alignable with the second cassette means so that a screw can be inserted from the opposite side of each of the first and second cassette means through the first unthreaded hole toward the one side of the other of the first and second cassette means and threadedly into the second threaded hole of the other cassette means.

9. A cylindrical lock assembly, which comprises:

a latchbolt;

a mechanism for moving the latchbolt between a latched position and an unlatched position;

a pair of sleeves extending from opposite sides of the mechanism and attached thereto for operating the mechanism upon rotation of the sleeves;

a pair of operators mounted on the sleeves for facilitating selective rotation of the sleeves;

a pair of springs mounted on the pair of sleeves for developing a spring return force when the operators are moved from a home position a facilitate the return of the operators to the home position when the operators are released;

a first cassette means for supporting one of the pair of springs on either side of the door;

a second cassette means identical in structure to the first cassette means for supporting the other of the pair of springs on either side of the door;

each of the first cassette means and the second cassette means being formed with a first hole which is unthreaded;

each of the first cassette means and the second cassette means being formed with a second hole which is threaded; and each of the first holes of the first and second cassette means being alignable with respective ones of the second holes of the other of the first and second cassette means within the cylindrical lock assembly.

* * * * *